US006840190B2

(12) United States Patent
Godek

(10) Patent No.: US 6,840,190 B2
(45) Date of Patent: Jan. 11, 2005

(54) KAYAK STORAGE COOLER

(76) Inventor: Joseph Godek, 17 Ledge Rd., Pelham, NH (US) 03076

( * ) Notice: Subject to any disclaimer, the term of this patent is extended or adjusted under 35 U.S.C. 154(b) by 0 days.

(21) Appl. No.: 10/280,300

(22) Filed: Oct. 24, 2002

(65) Prior Publication Data

US 2004/0079273 A1 Apr. 29, 2004

(51) Int. Cl.[7] ..... B63B 35/00
(52) U.S. Cl. ..... 114/347
(58) Field of Search ..... 114/343, 347, 114/364

(56) References Cited

U.S. PATENT DOCUMENTS 1,172,974 A * 2/1916 Frayser ..... 114/347
4,106,829 A * 8/1978 Dolle et al. ..... 312/235.8
4,398,488 A 8/1983 Mathieu
D280,263 S 8/1985 Hoye
4,871,079 A * 10/1989 Doucette et al. ..... 220/560
5,048,639 A 9/1991 Scherer
5,061,215 A * 10/1991 Walls ..... 441/45
5,501,169 A 3/1996 Denker
5,996,527 A * 12/1999 Ambrozic ..... 114/347
6,050,213 A 4/2000 Stevens
6,101,966 A 8/2000 Cumisky

* cited by examiner

*Primary Examiner*—Stephen Avila
(74) *Attorney, Agent, or Firm*—Robert R. DeLeault, Esq.; Mesmer & DeLeault, PLLC

(57) ABSTRACT

A kayak cooler has an enclosure with a rigid outside surface and a contoured bottom. The kayak cooler has a plurality of securing tabs disposed about the rigid outside surface of the enclosure. The enclosure has a top with an access opening and the contoured bottom has a shape approximating the contour of a foredeck of a kayak.

17 Claims, 7 Drawing Sheets

KAYAK STORAGE COOLER

BACKGROUND OF THE INVENTION

1. Field of the Invention

The present invention relates generally to the field of kayaks. Particularly, the present invention relates to an apparatus and method of retrievably stowing items on a kayak.

2. Description of Prior Art

A kayak is a pleasure craft that can be used on any body of water from quiet lakes to whitewater rivers to the open ocean. To use a kayak, the kayak operator sits in the vessel's cockpit, extends the legs underneath the foredeck of the vessel toward the bow, and optionally wraps a device known as a spray skirt around the waist. The spray skirt is then attached to the outer edges of the kayak, sealing the interior of the kayak from the environment. The operator then propels the kayak through the water using a two-headed paddle.

When a kayak is afloat in water, items stowed inside the kayak are not easily accessible to the kayak operator, whether or not the items are contained in storage bags or pouches. Thus, if the kayak operator needs or desires any item stowed inside the vessel (such as a drink, a snack, fishing bait, sunscreen, etc.), he or she must either reach under the kayak's decking system or turn and reach in back of him or her to a stern storage compartment, if so equipped. This is not only inconvenient for the operator, but it also puts the vessel at risk of rolling, which risks the safety of the vessel and of the kayak operator.

Portable coolers have been commercially available and used for some time. There have even been developed specially designed portable storage coolers for use with boats and the like. These storage coolers are adapted for use in canoes and wide-hulled open pleasure craft such as rowboats, motorboats, and the like.

U.S. Pat. No. 4,398,488 (1981, Mathieu) discloses a removable canoe cooler. This device is designed to wedge itself securely in place inside a canoe and can be removed from the vessel at will. The cooler rests inside the canoe. While well suited for use with canoes, this device could not be used inside of a kayak because most kayaks do not have an open hull. Most kayaks have a cockpit for the kayaker with little room for anything else.

U.S. Pat. No. 5,048,639 (1990, Scherer) discloses a removable cooler for use in a wide-hulled, open boat such as a motorboat or rowboat. The device is designed to sit on the bottom of the boat and provide an extra weight-bearing step as well as a cooler assembly. This device is well adapted to the vessel for which it is designed. Because a kayak has a confined opening in which the operator sits, there is little or no space to use such a device with a kayak, nor is there any reason to need such a dual-purpose device.

U.S. Pat. No. 5,501,169 (1996, Denker) discloses a multi-purpose bracket which clamps across both gunwales of a canoe. The multi-purpose bracket allows the canoe operator to mount various accessories thereupon such as catamaran coupling bars, portaging wheels and other such equipment that must be securely but temporarily affixed to the canoe. Such a device used on a kayak to secure stored items would necessarily be placed inside the hull across the kayak gunwales where the kayak operator is sitting. Because of the limited space in the cockpit of the kayak, the use of such a device with a kayak would not be practical.

U.S. Pat. No. 6,101,966 (2000, Cuminsky) discloses a utility station used with an adjustable mount in a pleasure craft. This device is well suited for use in an open-hulled boat, but would be impossible to mount in a closed-hull boat such as a kayak.

There are devices, however, that have been designed specifically for use with kayaks. U.S. Pat. No. 6,050,213 (1999, Stevens) discloses a device used to support a standard-sized beverage container on top of a kayak and within the reach of a kayak operator. This device is used to hold a single beverage container for a beverage being consumed by the kayak operator. However, it does not provide a means for storing additional beverage containers, or for keeping the beverage at a desired temperature during the kayak trip before it is consumed. Nor does it provide space to store a lunch, a bottle of sunscreen or any other item that a person might need or desire while kayaking.

Other types of storage devices designed specifically for kayaks exist in the marketplace. These devices stow items inside a nylon or other tough, flexible fabric container such as canvas, mesh or other similar material much like that used for a knapsack. They may or may not have a plurality of zippered pockets or pouches. They are attached to a kayak atop the kayak's foredeck within easy reach of the kayak operator. However, unlike the present invention, they are not rigid containers, nor are they insulated to provide a kayak cooler system, nor do they provide a beverage container holder built therein.

Further, these prior art devices are secured to the foredeck using either a loop system through which decklines must run to secure the device, or detachable hooks and stretchable cord attached to the device, or latching hooks that attach the device to the kayak's decklines.

Running decklines through the loops of these device requires the kayak operator to unlash the decklines and lace them through the loops, then re-lash the lines. Alternatively, the kayak operator could separately purchase latching hooks to attach the device to the decklines.

Therefore, what is needed is a device that is capable of safely stowing items on top of a kayak within a kayak operator's easy reach. What is also needed is a device that can be easily mounted to, and removed from, a kayak's decking system. What is further needed is a device that can insulate items from the outside elements and keep them at a desired temperature. What is still further needed is a device that does not interfere with kayak operator's safe use of the vessel.

SUMMARY OF THE INVENTION

It is an object of the present invention is to provide a device that mounts on top of the foredeck of a kayak capable of holding various items within easy reach of the operator. It is another object of the present invention is to provide a storage device for a kayak that keeps stowed items at a substantially constant temperature and protected from the environment. It is a further object of the present invention is to provide a device that can be used for storage on board a kayak that does not jeopardize the kayak operator's safety. It is still another object of the present invention is to provide a device that is easy to install and remove from the foredeck of the kayak. It is yet another object of the present invention is to provide a storage container that is contoured to the foredeck of kayaks to provide a low profile and a stable cooler device especially during use of the kayak.

The present invention achieves these and other objectives by providing a kayak cooler that can be installed on the foredeck of a kayak and secured in place using the kayak's existing decklines. The decklines are typically made of stretchable cord. The kayak cooler has a plurality of securing tabs laterally spaced about the bottom of the container. The tabs are large enough to accommodate the decklines across the tabs, which function to hold the cooler in place yet allow for easy and quick removal from the kayak.

The kayak cooler may be a single large compartment having a contour shaped bottom that approximates the shape of the kayak foredeck, or it may include two compartments that are attached to each other. The compartment has at least one topside access port and an optional recess, which functions as a holder for a standard-sized beverage container such as a soft drink can or water bottle, located on the side of the storage container adjacent the cockpit of the kayak. In the two-compartment configuration, the device may include at least one topside access port in each compartment. The two-compartment configuration may also include a flexible hinge between each compartment providing a way of more closely adjusting the fit of the kayak cooler to the kayak foredeck. In such an embodiment, the beverage holder may be evenly divided between the outside surfaces of the two compartments. Other embodiments may have front or side entry access openings into the compartment(s), or may lack a recess for holding a beverage container.

In the two-compartment embodiment, each compartment is somewhat rectangular in shape and made of a durable insulating material that maintains its shape and minimizes the transfer of heat between the surrounding environment and the inside of the compartment. The compartments generally have a concave bottom contoured to approximate the profile of a kayak foredeck. The central hinge may be made of a sheet of flexible material, separate mating hinges, or formed into the compartments when they are made. This configuration provides the kayak cooler with flexibility and allows it to be used on any type of kayak. Obviously, in other embodiments where there is only one compartment, no hinge is required, but the compartment bottom is still contoured to approximate the profile of a kayak foredeck.

Regardless of the number of compartments, the kayak cooler includes at least one access port to each compartment, located on the top, front or side of each compartment. The access ports are typically located such that they are easy to load and unload and can be easily reached by a kayak operator when he or she is seated in the kayak. Each compartment may optionally include a drain plug for draining water from inside the compartment due to melting ice when ice is used as the cooling substance.

The access port typically includes a cover that may be hingedly attached to the access port or may be a separate cover with a tether to the access port to prevent inadvertent loss of the cover. Examples of useable joining mechanisms for holding the cover in place over the access port are a zipper, a hook-and-loop fastening system, snaps, buckles, elastic cord, preformed ridges with mating recesses, or any other means for temporarily securing the cover to the kayak cooler.

In addition, the compartments are manufactured to such a length and width as to sit completely on top of a kayak deck and not overhang any edge of the kayak. The compartments are also manufactured to a height (or depth, depending on perspective) of less than one foot but greater than 2.5 inches, such that a standard-sized beverage container may be placed inside. This embodiment ensures that the kayak cooler will not impair the vision of the kayak operator when he or she is seated in the vessel.

The kayak cooler may also include a beverage holder for holding a standard beverage container that is being consumed. The beverage holder is preferably located at a position on the storage cooler such that it is nearest the kayak operator. In other embodiments, the beverage holder may be located in some other position, such as in the center of the kayak cooler, or it may not be included at all. The depth of the beverage holder may vary so long as it is sufficient to hold and support the beverage container when placed therein, yet allow for easy removal.

The storage cooler may also include its own webbing, side release buckles, D-rings or other mechanisms to provide the operator with a variety of attachment points for additional gear.

To install the kayak cooler onto a kayak, an operator places the cooler on top of the kayak's foredeck. The operator then pulls the existing deck lines over the tabs protruding laterally from the bottom or side edge of the cooler such that the tabs fit firmly under the decklines, which secure the cooler in place. Use of tabs and decklines allows the kayak cooler to be quickly and easily installed or removed from the kayak.

DETAILED DESCRIPTION OF THE PREFERRED EMBODIMENT

Figure 1:
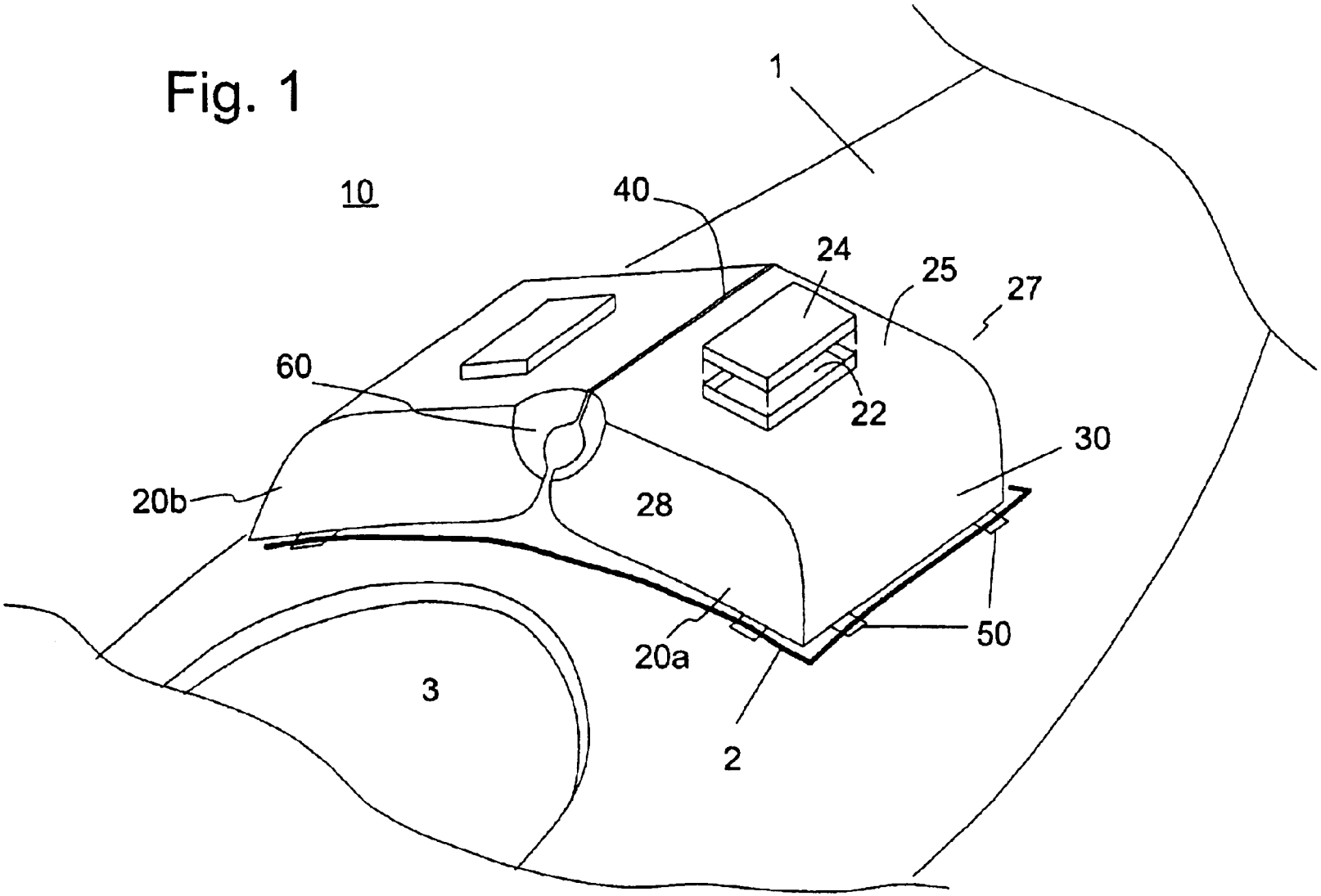
FIG. 1 is a perspective view of the preferred embodiment of the present invention installed on the foredeck of a kayak.

The preferred embodiment(s) of the present invention is illustrated in FIGS. 1–7. Referring now to FIG. 1, there is shown a perspective view of a kayak cooler 10 installed on a kayak 1 in front of a cockpit 3 and held in place by decklines 2. Kayak cooler 10 includes two compartment structures 20*a* and 20*b*, a hinge structure 40, a plurality of securing tabs 50, and a beverage holder 60. Compartment structures 20*a* and 20*b* each have an access port 22 with a cover 24.

Compartment structures 20*a* and 20*b* are substantially mirror images of each other such that when in use one is used as a right-hand component and the other is used as a left-hand component. It is understood that compartment structures 20*a* and 20*b* may vary in size from each other, may or may not be identical in shape, or may not be mirror images of each other.

Figure 2:
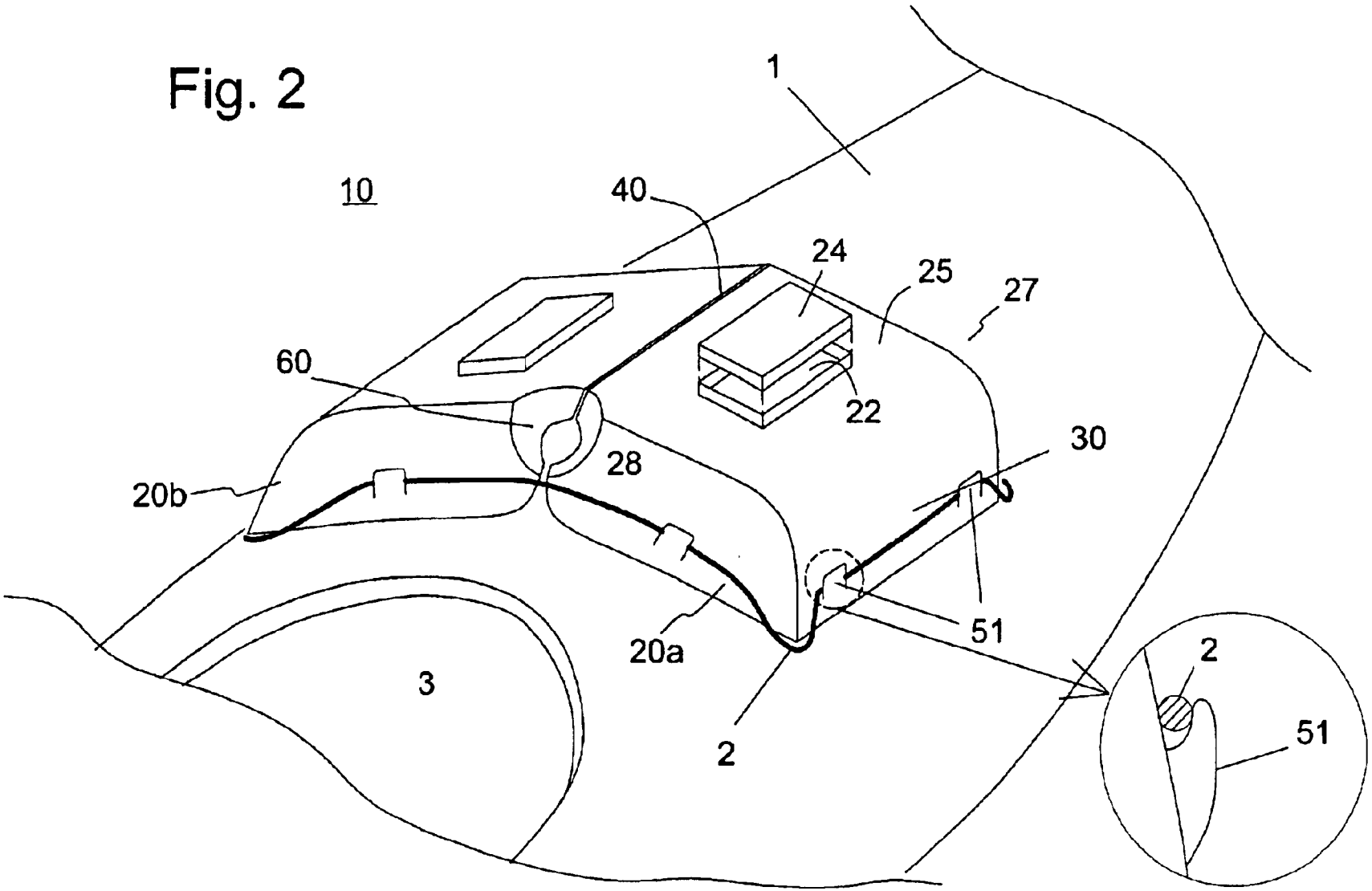
FIG. 2 is a perspective view of another embodiment of the securing components of the present invention.

Compartment structures 20*a* and 20*b* are preferably hollow rectangularly-shaped structures with external, contoured surfaces where each has a top surface 25, a bottom contoured surface 26 (not shown), a front surface 27 (not shown), a back surface 28, a medial side surface 29 (not shown), and a distal side surface 30. Securing tabs 50 extend laterally from the peripheral edge of contoured bottom surface 26. Compartment structures 20*a* and 20*b* are made of a durable insulating material that maintains its shape once formed and minimizes the heat transfer between items placed inside kayak cooler 10 and the surrounding environment. Compartment structures 20*a* and 20*b* may be made from sandwiched reinforced plastic layers, styrofoam, polyethylene or another plastic or nonplastic material having relatively good durability and insulating properties. The material used may be coated or covered with metal, plastic, nylon, mesh, or other material if desired. Securing tabs 50 preferably extend laterally from the peripheral edge of contoured bottom 26. An alternative design of securing tabs 50 includes, but is not limited to, a plurality of securing tabs or components 51 disposed about the outside rigid surface of kayak cooler 10 as shown in FIG. 2.

Figure 3:
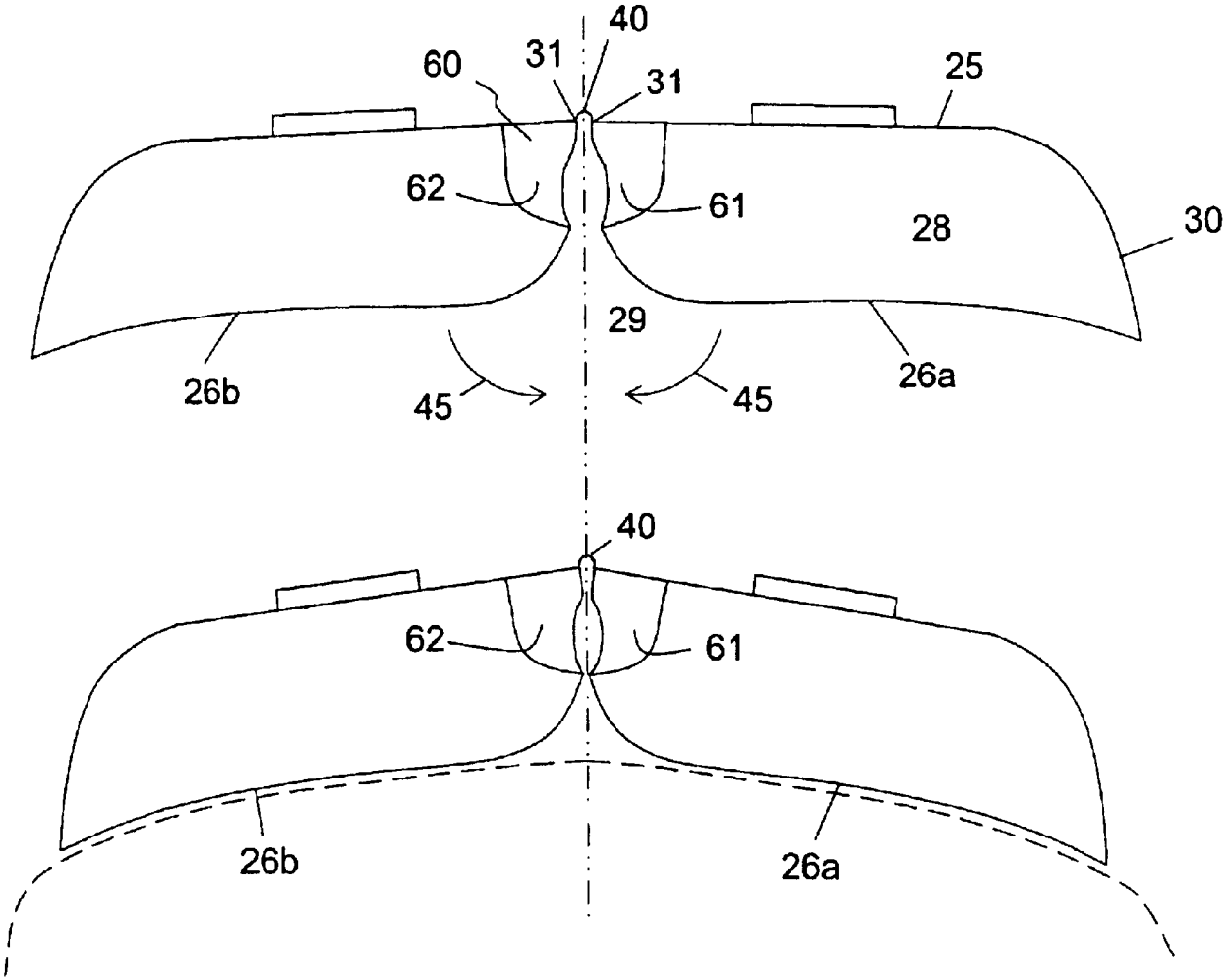
FIG. 3 is a back view of a hinged, two-compartment embodiment of the present invention showing the adjustable feature of the hinged embodiment.

Turning now to FIG. 3, there is illustrated a back view of kayak cooler 10. Bottom surface 26 is preferably contoured with a concave-type shape that better complements the convex-shaped foredeck of a typical kayak. Compartment structures 20*a* and 20*b* are connected to each other by flexible hinge structure 40 along the top facing edge 31 of each compartment structure 20*a* and 20*b*. It is noted that the flexible hinge structure 40 may also be attached to medial side surface 29 of each compartment structure 20*a* and 20*b* so long as the two compartments are allowed to flex to fit the contour of the foredeck of kayak 1. Beverage holder or recess 60 is formed by arc surfaces 61 and 62 in compartment structures 20*a* and 20*b*. Hinge structure 40 allows compartment structures 20*a* and 20*b* to pivot about hinge structure 40 and move toward each other as indicated by arrows 45. The adjustability of kayak cooler 10 along with the contoured bottoms 26*a* and 26*b* allows the present invention to adjust to the typically convex shape of the foredeck of a kayak as indicated by the dashed lines 3.

Compartment structures 20*a* and 20*b* may be manufactured as one piece or the sides may be manufactured separately and secured together by welding, brazing, caulking, bolting, gluing, or other means for securing two pieces of material together. Compartment structures 20*a* and 20*b* are typically less than one foot in depth but more than 2.5 inches. This embodiment ensures that kayak cooler 10 will not impair the vision of the kayak operator, yet will allow a standard-sized beverage container to be stowed inside.

Figure 4:
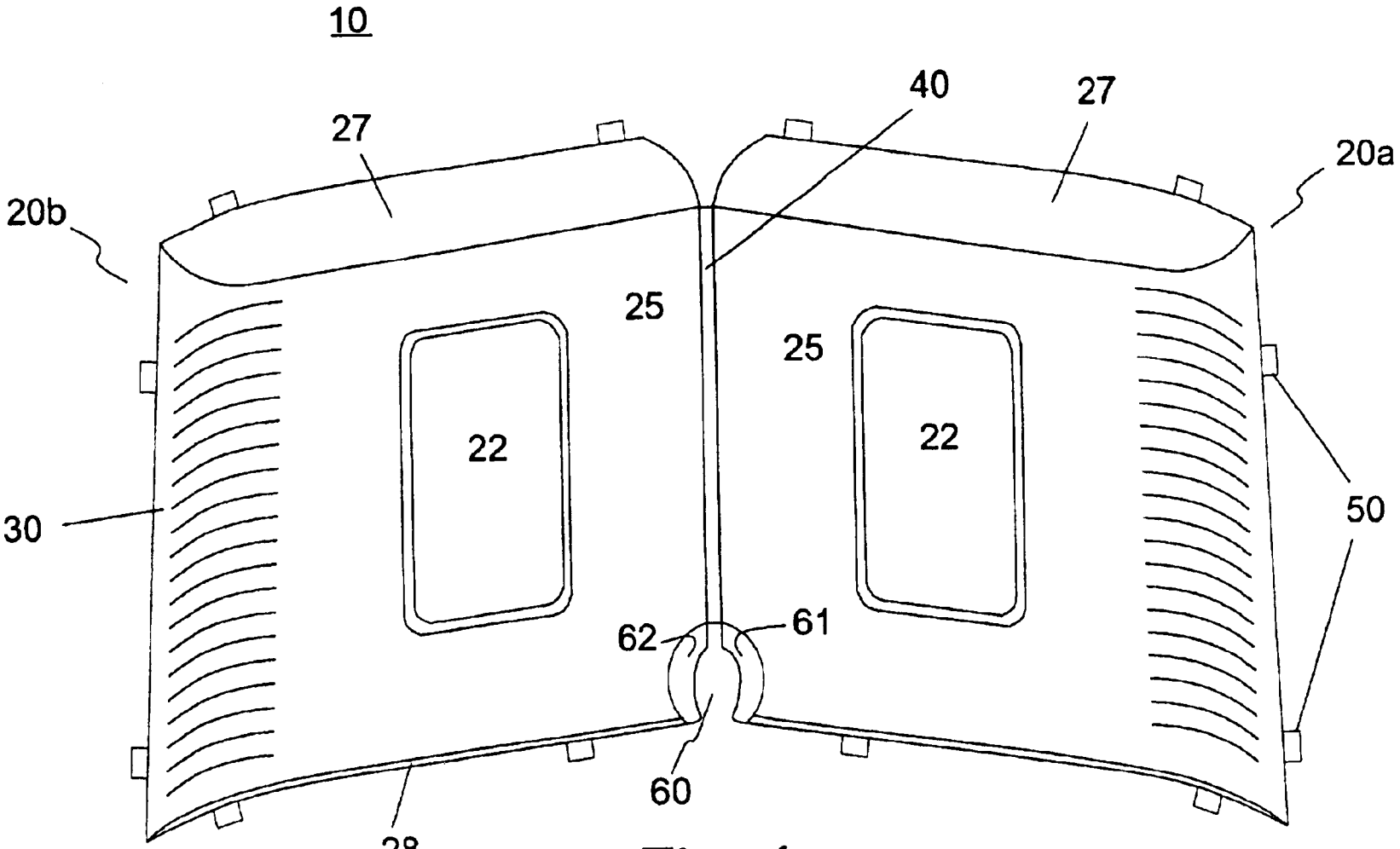
FIG. 4 is a top view of one embodiment of the present invention showing the access ports, the securing tabs and a beverage holder.

As shown in FIG. 4, front surface 27 is an angled surface to provide a more aerodynamic shape to kayak cooler 10, which provides for less wind resistance when paddling kayak 1 in a forward direction than if front surface 27 was perpendicular to the bottom. Beverage holder 60 is formed by arc surfaces 61 and 62 located in compartment structures 20*a* and 20*b*, respectively. Arc surfaces 61 and 62 are formed into the corner of compartment structures 20*a* and 20*b* where top 25, medial side 29 (not shown), and back 28 join. In this location, holder 60 is located along the centerline of kayak cooler 10 and is directly in front of the kayak operator when he or she is seated in the vessel. However, in other embodiments, holder 60 may be located anywhere in compartment structure 20*a* or 20*b*, or cooler 10 may contain a plurality of beverage holders or none at all.

Arc surfaces 61 and 62, located in compartment structures 20*a* and 20*b*, respectively, are surfaces of approximately the same radius and are preferably mirror images of one another. In other words, arc surface 61, located on compartment structure 20*a*, faces arc surface 62, located on compartment structure 20*b*. When juxtaposed, arc surfaces 61 and 62 comprise beverage holder 60, which is substantially semicircular in shape.

Arc surfaces 61 and 62 are preferably of such a radius as to receive and support a standard-sized beverage container when a standard-sized beverage container is inserted into holder 60. Accordingly, holder 60 may be of a depth equal to the entire height of compartment structures 20*a* and 20*b* or of a depth equal to only a portion of the height of compartments 20*a* and 20*b*, yet allows easy removal of the beverage container from holder 60.

Figure 5:
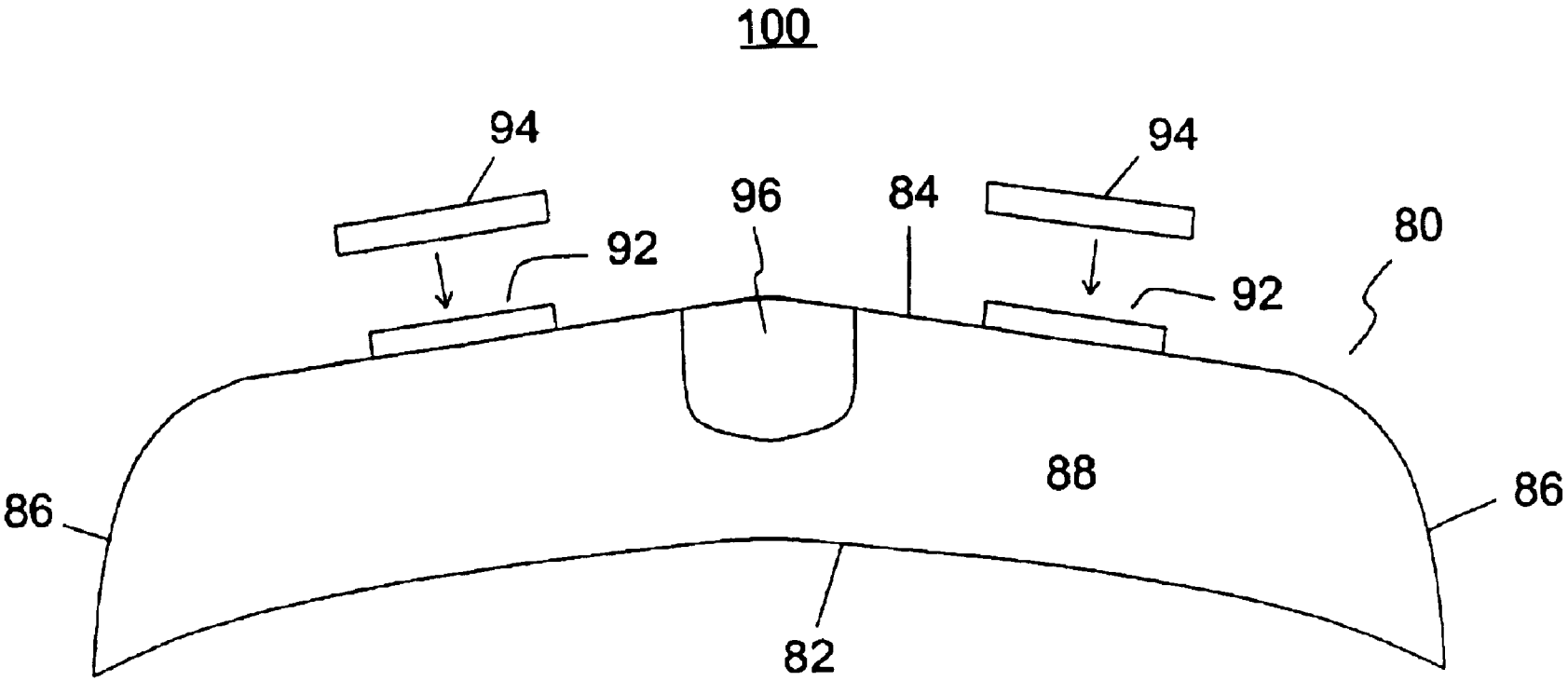
FIG. 5 is a back view of another embodiment of the present invention showing a fixed shape container with removable access covers.

Turning now to FIG. 5, there is shown a back view of another embodiment of the present invention. This embodiment shows kayak cooler 100 as a single compartment structure 80 with a contoured bottom 82, a V-shaped or cathedral top 84, sides 86, a back 88, a front 90 (not shown), a pair of access openings 92 with optional covers 94. At the apex of top 84 and adjacent to and in communication with back 88 is a recess forming beverage holder 96. Unlike the embodiment shown in FIGS. 1–4, this embodiment of the present invention does not have a hinge structure and, thus, cannot be adjusted to fit the foredeck of all kayaks. Either a variety of contours may be offered, each one sized to fit a particular width and shape of the foredeck or a filler/adapter pad may be provided that adapts the surface of bottom 82 to the width and shape of the foredeck.

Figure 6:
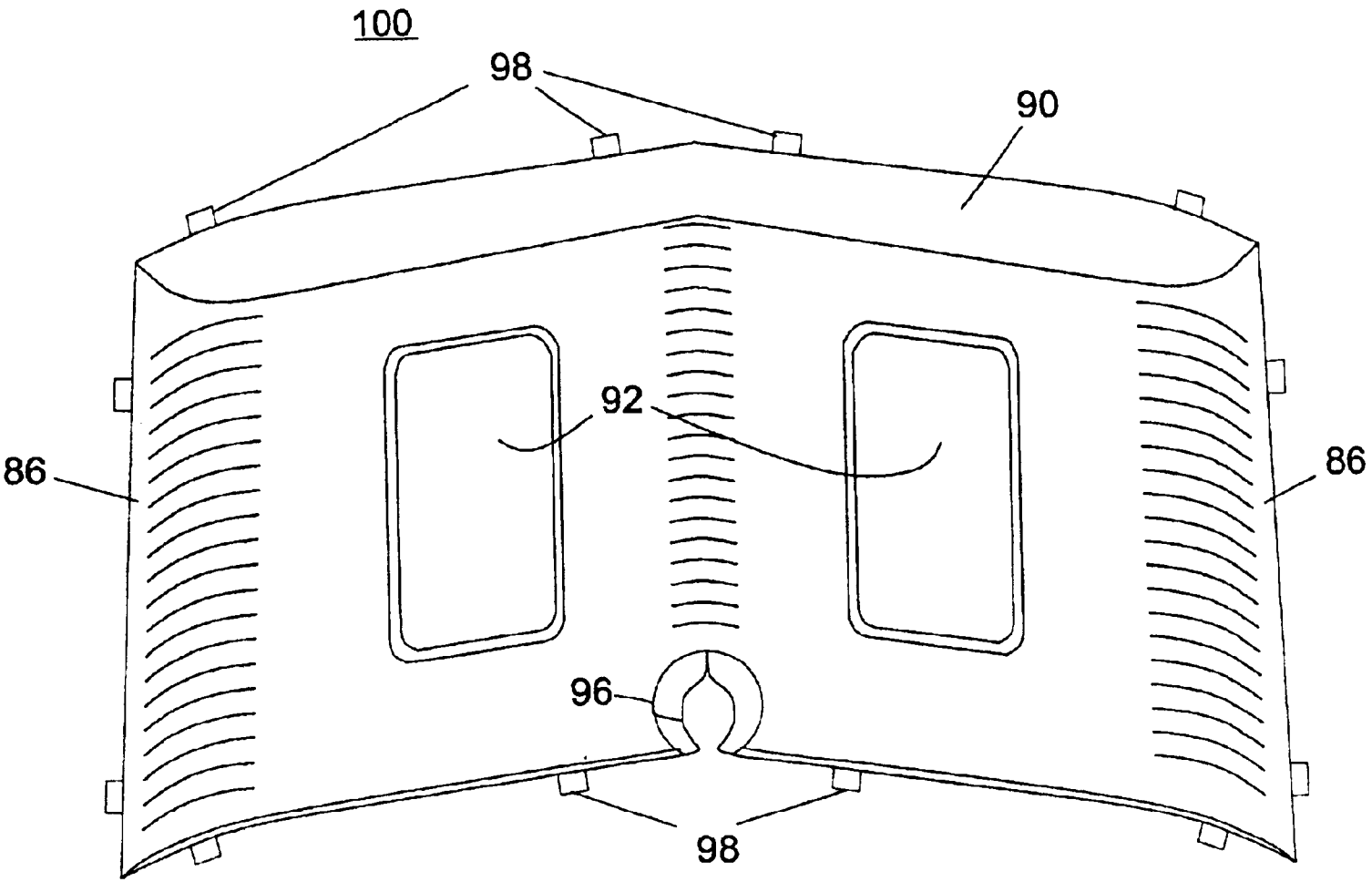
FIG. 6 is a top view of the embodiment shown in FIG. 5.

FIG. 6 shows a top view of the embodiment shown in FIG. 5. Front 90 not only has a sloping surface to give the front of kayak cooler 100 an aerodynamic shape, front 90 preferably has a V-shape with the apex of the V at the centerline of kayak cooler 100 and trailing towards sides 86. It should be understood that front 90 may also have an arcuate or convex shape or any shape that gives kayak cooler 100 an aerodynamic shape to reduce wind resistance when kayak 1 is moving through the water. Beverage holder 96 is sized to receive a beverage can or bottle and is preferably located so that the beverage is within easy reach of a kayak operator. Although access openings 92 are shown as having an oblong shape, they may be any shape such as square, rectangular, round, oval, elliptical, etc. A plurality of securing tabs 98 are located around the periphery of bottom 82.

Access openings 92 may be of any size or shape but is preferably of a size and shape that will comfortably accommodate a standard-sized beverage container. As also shown in FIG. 5, access openings 92 are sealed by a cover 94 which minimizes the heat transfer between the contents of compartment 80 and the surrounding environment. Preferably, cover 94 is made of the same insulating material as compartment 80.

Figure 7:
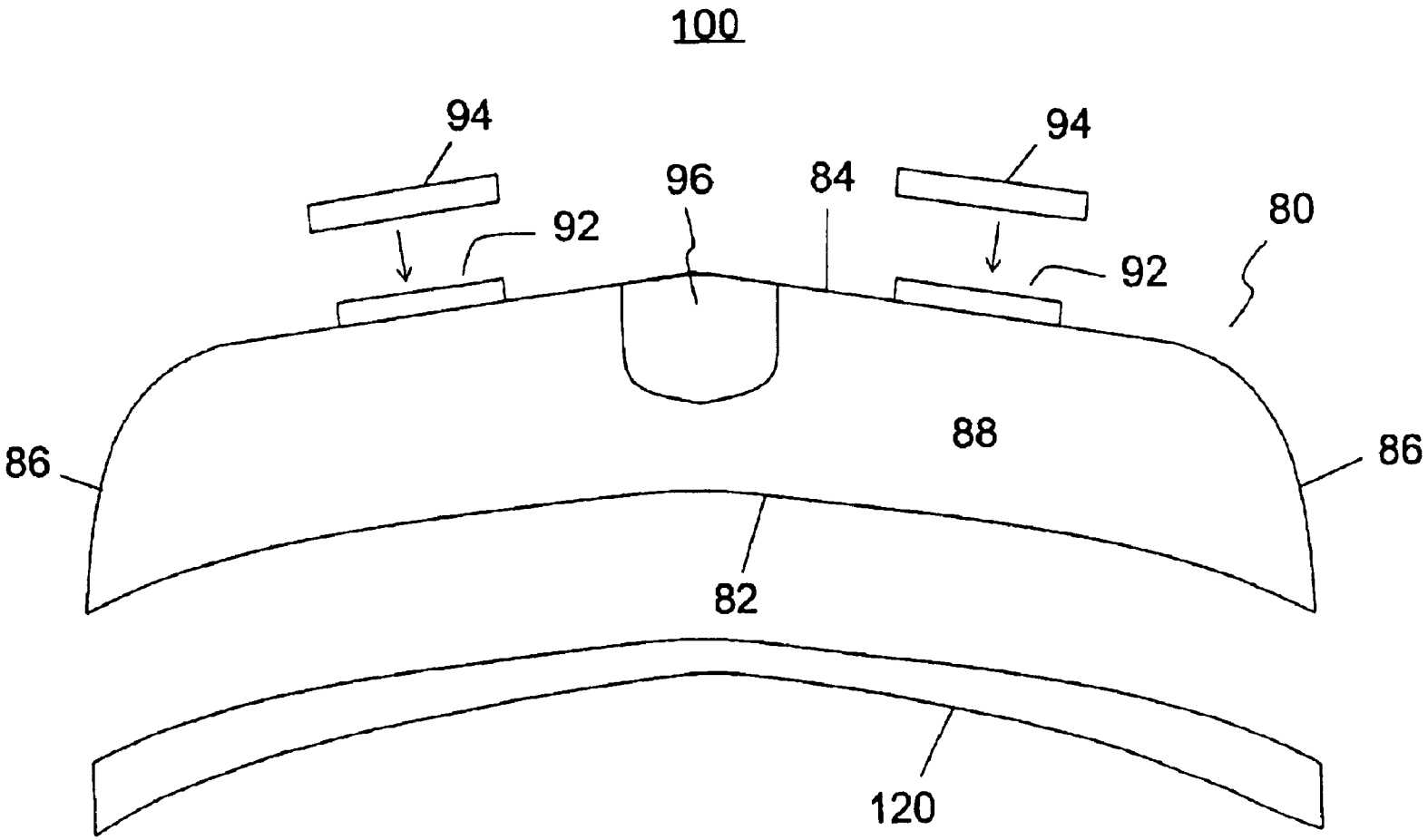
FIG. 7 is a back view of the embodiment of the present invention in FIG. 5 showing a mounting adapter adjacent the contoured bottom.

To install kayak cooler 10 onto kayak 1, an operator places it on top of the foredeck of kayak 1 such that concave bottom 26 is resting on the deck. Kayak cooler 10 should then be maneuvered to locate distal side 30 on compartment structure 20*a* on the port side of kayak 1 and distal side 30 on compartment structure 20*b* on the starboard side of kayak 1. In this configuration, holder 60 should be in front of and on the centerline of cockpit 3 in kayak 1. To complete installation, the operator pulls the existing deck lines over the peripheral securing tabs 50 of compartment structures 20*a* and 20*b* and adjusts them such that kayak cooler 10 fits firmly under the decklines and is secured in place. For kayak cooler 10 where a hinge mechanism between compartment structures 20*a* and 20*b* does not exist, a mounting adapter 120 may be used and installed between the foredeck of kayak 1 and the kayak cooler 10 as shown in FIG. 7. Mounting adapter 120 is made of an elastomeric, preferably non-slip, material that is compressible and capable of conforming to the contoured bottom surface 26 on one side and to the foredeck of kayak 1 on the other side. Mounting adapter 120 permits a kayak cooler with a fixed bottom contour to be mounted to a kayak foredeck that does not substantially match the bottom contour of the kayak cooler.

Kayak cooler 10 may also be secured to the deck of kayak 1 with additional shock-cord lacing, webbing, or release buckles joined to the existing decklines if desired. Further, kayak cooler 10 may include its own webbing, side release buckles, D-rings or other mechanisms which provide a variety of attachment points for additional gear.

To use kayak cooler 10 once it is installed on kayak 1, the operator opens covers 24 to expose access ports 22 and inserts all items desired to be kept top side into compartment structures 20*a* and 20*b*. When all items are stowed, the operator closes covers 24 to seal access ports 22. If covers 24 are not self securing and has a joining mechanism, the operator must secure it in place to ensure items will not dislodge from compartment structures 20*a* and 20*b* when transporting or using kayak 1.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A kayak cooler comprising:

an enclosure having a contoured bottom, a top with an access opening, and a rigid outside surface having a front surface shaped to provide an aerodynamic characteristic to said enclosure, said contoured bottom having a shape approximating the contour of a foredeck of a kayak; and a plurality of securing tabs disposed about the rigid outside surface of said enclosure.

2. The kayak cooler of claim 1 wherein said plurality of securing tabs laterally extend from the peripheral edge of said contoured bottom.

3. The kayak cooler of claim 1 wherein said plurality of securing tabs are of a sufficient size capable of being engaged by a kayak's deckline.

4. The kayak cooler of claim 1 further comprising a mounting adapter for placement between said contoured bottom and said foredeck of said kayak.

5. The kayak cooler at claim 1 further comprising a beverage holder within said outside surface of said enclosure.

6. The kayak cooler of claim 1 further comprising a cover sized to engage said access opening.

7. The kayak cooler of claim 1 wherein said enclosure is sufficiently large to store a beverage container.

8. The kayak cooler of claim 1 wherein said top is V-shaped.

9. The kayak cooler of claim 1 wherein said enclosure further includes a first compartment structure, a second compartment structure and a hinge component connecting said first compartment structure to said second compartment structure.

10. The kayak cooler of claim 9 further comprising at least one access opening in each of said first compartment structure and said second compartment structure.

11. The kayak cooler of claim 9 further comprising a beverage holder within said outside surface of said enclosure.

12. A kayak cooler comprising:

a first compartment structure having a contoured first bottom and at least one first access opening;

a second compartment structure having a contoured second bottom and at least one second access opening;

a hinge structure between said first compartment and said second compartment; and a plurality of securing components extending about the periphery of said first and second compartment.

13. The kayak cooler of claim 12 further comprising a beverage holder formed by mirror image arc surfaces opposed to each other wherein said mirror image arc surfaces are shaped within an outside surface of said first compartment structure and said second compartment structure.

14. The kayak cooler of claim 12 wherein said plurality of securing components extend laterally from the peripheral edge of said first contoured bottom and said second contoured bottom.

15. The kayak cooler of claim 12 wherein said kayak cooler has an aerodynamic shape.

16. The kayak cooler of claim 12 further comprising at least one cover for said at least one access opening.

17. The kayak cooler of claim 12 wherein each of said plurality of securing tabs are of a sufficient size capable of being engaged by a kayak's deckline.

* * * * *